United States Patent [19]

Mankowski

[11] Patent Number: 5,070,771

[45] Date of Patent: Dec. 10, 1991

[54] ROOF VENTILATOR

[76] Inventor: John P. Mankowski, 70 Boston Blvd. W, Detroit, Mich. 48202

[21] Appl. No.: 538,534

[22] Filed: Jun. 15, 1990

[51] Int. Cl.[5] ..... F24F 7/02

[52] U.S. Cl. ..... 454/275; 454/365; 454/367

[58] Field of Search ..... 98/42.21, 42.2; 52/199

[56] References Cited

U.S. PATENT DOCUMENTS

| | | | |
|---|---|---|---|
| Re. 27,943 | 3/1974 | Smith | 98/42.21 |
| 2,636,429 | 4/1953 | Parsons | 98/42.22 |
| 2,692,548 | 10/1954 | Knorr | 98/42.22 |
| 3,895,467 | 7/1975 | Clement | 98/42.22 X |
| 4,280,399 | 7/1981 | Cunning | 98/42.21 |
| 4,558,637 | 12/1985 | Mason | 98/42.21 |
| 4,642,958 | 2/1987 | Pewitt | 98/42.21 X |
| 4,817,506 | 4/1989 | Cashman | 98/42.21 |
| 4,903,445 | 2/1990 | Mankowski | 98/42.21 X |
| 4,924,761 | 5/1990 | MacLeod et al. | 98/42.22 X |

*Primary Examiner*—Harold Joyce
*Attorney, Agent, or Firm*—Lynn E. Cargill

[57] ABSTRACT

A roof ridge ventilator to be installed under a cap shingle includes a one piece cover member of an elongated shape including a pair of flaps, each flap having one upper surface over which cap shingles are secured and also having downwardly facing lower surfaces, a pair of vents respectively secured to the lower surface of the cover member flaps, each vent including at least one set of shielded louvers having a plurality of openings for deflecting air flow while maintaining a minimum free area for air passage such that the air flowing therethrough is substantially reduced in velocity to limit the infiltration of foreign matter. A plurality of longitudinally spaced supports in each vent extend substantially vertically to permit nailing onto the roof such that the vent does not collapse during installation and such that the net free area remains intact. In another embodiment, a roof ventilator to be installed under a shingle atop a roof surface is disclosed which includes a one piece cover member of an elongated shape having an upper surface over which a shingle is secured, the cover member including a longitudinally extending portion to be secured onto the roof surface. At least one vent is secured to the lower surface of the cover member flap, the vent including at least one set of shielded louvers having a plurality of openings for deflecting the air flow while maintaining a minimum free area for air passage therethrough.

24 Claims, 4 Drawing Sheets

FIG 4A
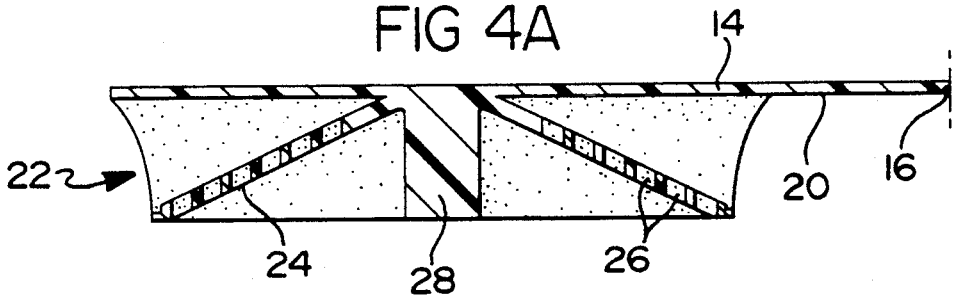
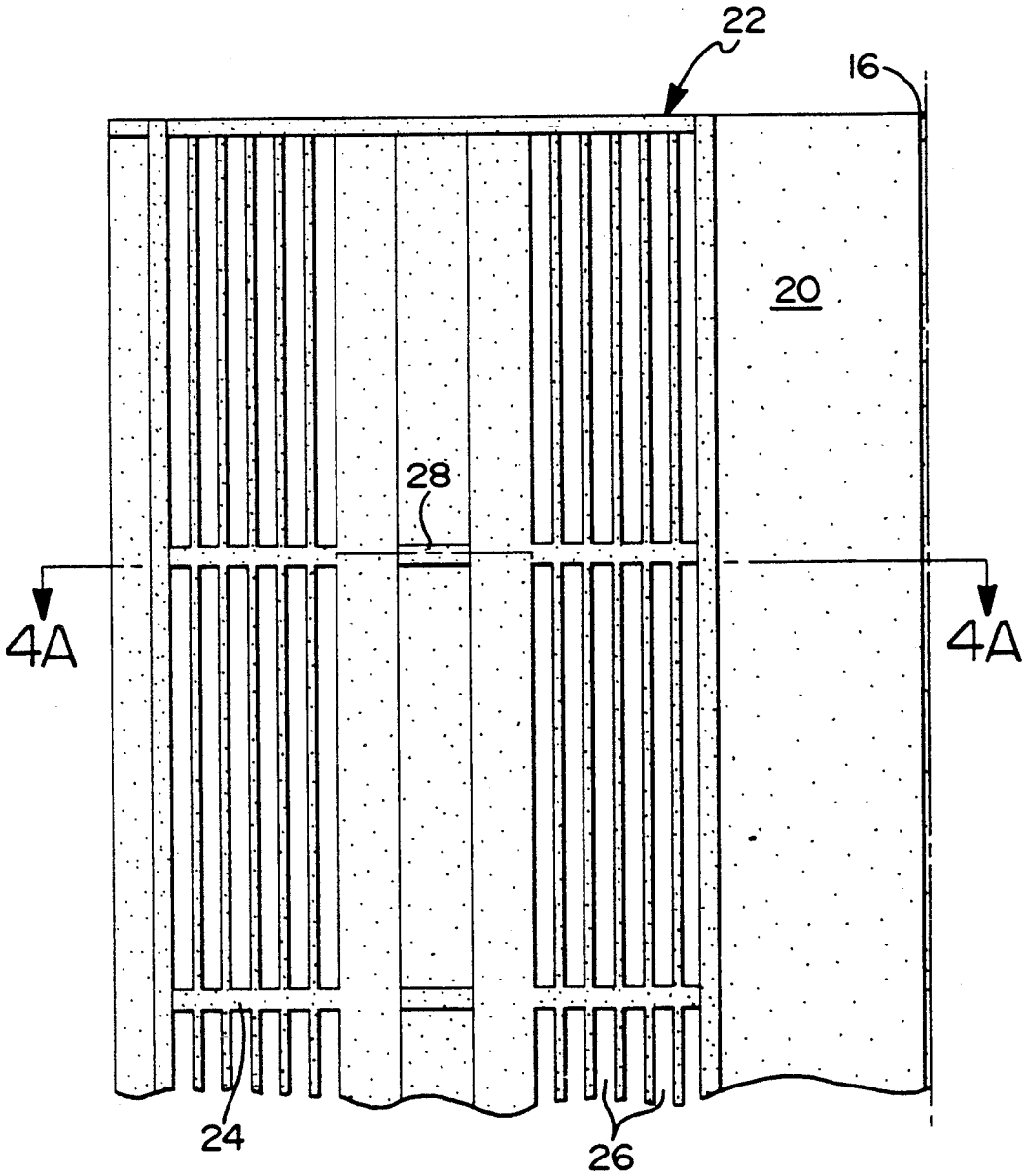
FIG 3

ROOF VENTILATOR

TECHNICAL FIELD

This invention relates to a roof ventilator.

BACKGROUND OF THE INVENTION

Roof ridge ventilators permit circulation of hot air through the roof of a building to decrease the temperature within the building and to allow for air circulation under the roof, especially desirable for the removal of moisture build-up to prevent rotting of wooden members. Conventionally, roof ventilators have been unsightly, and have further served as nesting places for birds, insects and the like.

Some of the problems with previous roof ventilators have included a projecting height which is too great, multi-piece constructions which are difficult to install, roof ventilators which are unable to adapt to various roof pitches, thereby requiring a multitude of products for different building types and roof ventilators which are generally unsightly.

Furthermore, it has been found that roof ventilators must be of a sturdy construction to withstand pressures of shipping and handling, and should not be able to be easily damaged. Furthermore, other considerations for shipping and handling include the ability of a design to provide a compact ventilator, one that can be shipped in a flat position, and one that can be stored in inclement weather conditions. Further considerations in the design of a roof ventilator include aesthetics, propensity of air volume circulation, resistance to deterioration, ability to withstand exposure to high winds and other inclement weather conditions, along with its ability to prevent dirt, rain and insects into the attic space being ventilated.

An object of the present invention is to provide an improved roof ventilator having particular utility in the construction of residential and commercial buildings.

Yet another object of the present invention is to direct air flow so as to reduce the velocity of the air flowing therethrough such as to limit entry of foreign particles through the roof into the ventilated space below.

It is yet still another object of the present invention to provide a roof ventilator which can easily be manufactured and easily installed.

Previous inventions have included roof ridge ventilators which are placed on top of the shingles, such as U.S. Pat. No. 3,481,263 issued to M. C. Belden on Dec. 2, 1966 and U.S. Pat. No. 3,303,773 issued to L. L. Smith, et al., on Feb. 14, 1967. More recent inventions include roof ridge ventilators which are placed underneath cap shingles, for example, U.S. Pat. Nos. 3,236,170 issued to Meyer, et al., 4,280,399 issued to Joseph M. Cunning and 4,676,147 issued to the present inventor, John P. Mankowski.

U.S. Pat. No. 4,817,506 to Cashman included vertical struts to provide structural support. He further disclosed non-louver slit openings to permit air flow therethrough. However, the Cashman invention includes so many vertical struts that the net free area is greatly reduced thereby impeding and restricting air flow by creating maximum restriction areas. The present invention achieves an even greater net free area by providing a roof ventilator having a sufficient structural static load bearing capability without the need for the vertical struts which so greatly reduce the net free area.

DISCLOSURE OF INVENTION

In accordance with the present invention, an improved roof ventilator is provided having increased air flow due to proper air direction through the ventilator. Rain, insects and dirt particles are prevented from entering the ventilated space while retaining compact size, low cost, ease of manufacture, ease of installation, sturdiness, and longevity. Essentially, the present roof ventilator may either be used as a singular ventilator to be installed in the lower portion of the roof or as a roof ridge ventilator including a pair of vents adapted to extend longitudinally on a roof ridge covering the peak of the roof ridge. The single roof ventilator is installed by cutting a slot in the roof, in the area of the roof over which the roof ventilator is being installed, and nails or other fastening means are directed through the ventilator to secure it to the roof. The roof ridge ventilator is placed into position by merely laying the ventilator over the peak of the roof, and nailing through the ventilator into the materials below.

The singular roof ventilator which may be installed in a lower portion of the roof includes a one-piece cover member with an upper surface over which a shingle is to be secured and at least one vent secured to the lower surface of the cover member. The cover member includes a longitudinally extending portion to be secured onto the roof surface and may include a plurality of longitudinally spaced support in the vent that extend substantially vertically to permit nailing onto the roof such that the vent will not collapse during installation and such that the net free area remains intact. The vent includes at least one set of shielded louvers with a plurality of openings for deflecting air flowing therethrough.

Specifically, the present invention for the roof ridge ventilator includes a one-piece cover member of an elongated shape which includes a pair of flaps, each flap having an upper surface over which the cap shingles are secured and a downwardly facing lower surface which has a pair of vents secured thereto for deflecting air flow while maintaining a minimum free area for air passage such that the air flowing therethrough is substantially reduced in velocity to limit the infiltration of foreign matter. Each vent may also have longitudinally spaced-apart supports that extend substantially vertically to permit nailing onto the roof such that the vent does not collapse during installation and such that the net free area remains intact. These vents run substantially perpendicular to the line of the roof and to limit the entry of dirt, insects and other foreign particles into the ventilated space, as well as providing structural support.

In another embodiment, the ventilator may be used as a roof ventilator to be installed in the lower portion of the roof. The roof ventilator may be used mid-roof in order to aid in ventilation, and is intended to be installed underneath the shingles. For installation, a hole is cut in the roof, the vent is nailed on top of the hole, and a shingle is nailed on top of the vent.

The objects, features, and advantages of the present invention are readily apparent from the following detailed description of the best mode for carrying out the invention when taken in connection with the accompanying drawings.

BRIEF DESCRIPTION OF THE DRAWINGS

The nature and extent of the present invention will be clear from the following detailed description of the particular embodiments thereof, taken in conjunction with the appendant drawings, in which:

FIG. 3 is a bottom plan view of a vent showing the relative locations of the shielded louver openings and the location of the supports of one of the embodiments;

FIG. 4*a* is a side sectional view of the vent shown in FIG. 3 including an upwardly facing shielded louver with a center support;

BEST MODE FOR CARRYING OUT THE INVENTION

Figure 1:
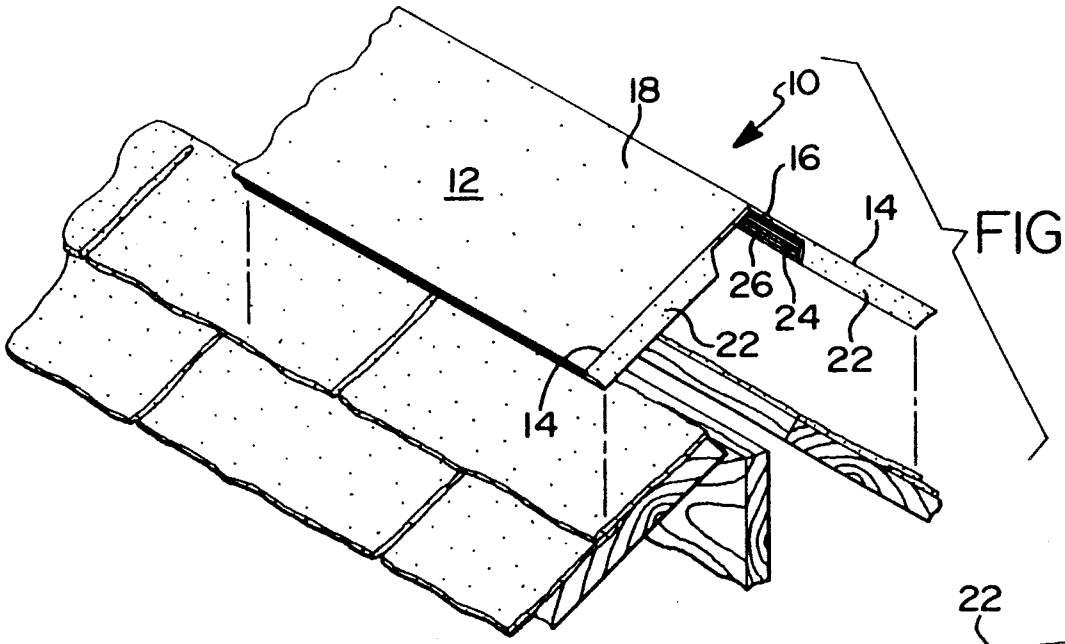
FIG. 1 is an environmental view of a roof ridge ventilator constructed in accordance with the present invention and located over the open space at the peak of the roof.
Figure 2:
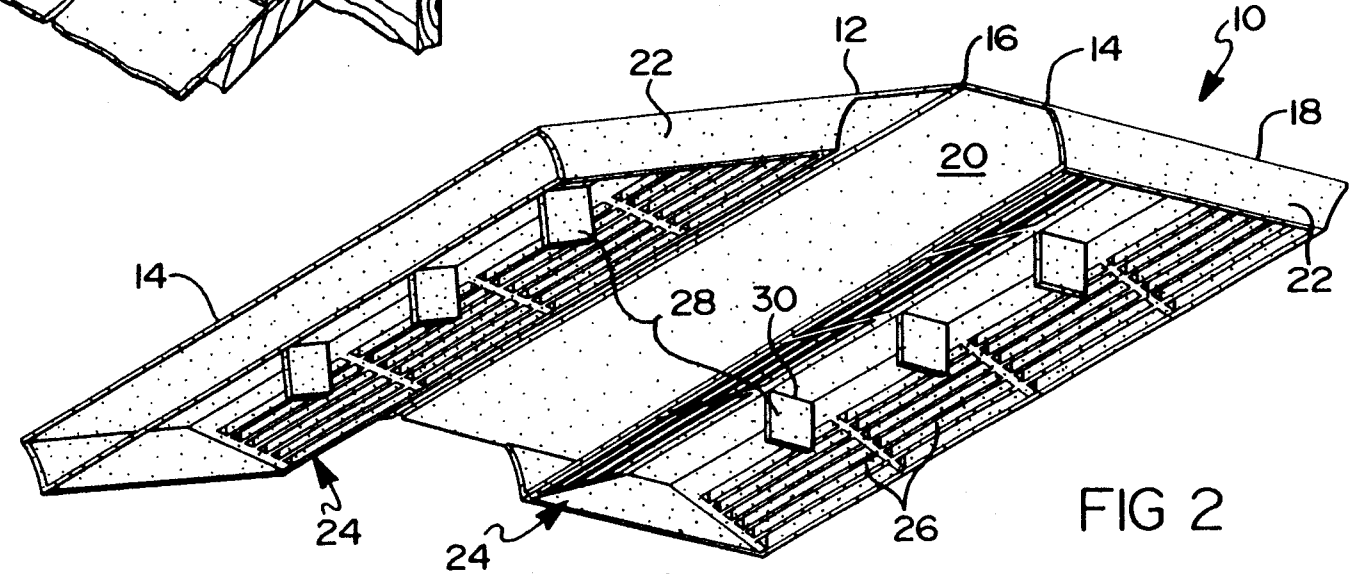
FIG. 2 is a perspective bottom view with the vent and the shielded louvers at an upward incline.

With combined reference to FIGS. 1 and 2 of the drawings, the first embodiment of the invention is shown as a roof ridge ventilator constructed in accordance with the present invention and is generally indicated by reference number 10, having particular utility in the construction of residential and commercial buildings. Roof ridge ventilator 10 includes a one-piece cover member 12 of an elongated shape including a pair of flaps 14 and a hinge 16 unitary with the flaps and furthermore includes a longitudinal groove therebetween. The construction of the cover member 12 permits use of the ventilator 10 on roof ridges of varying pitches and angles. The ventilator may be any length, but it is preferably about 4 to 5 feet long. Cover member 12 has an upper surface 18 over which cap shinqles (not shown) are secured. The securement is normally provided by nailing through both the cap shingles and the ventilator 10 and is hereinafter more fully described.

Roof ridge ventilator 10 also includes a pair of vents 22 respectively located beneath the pair of cover member flaps 14. As hereinafter more fully described, each vent 22 has at least one vent wall 24 having a plurality of vent openings 26 as illustrated in FIGS. 1 through 5 to permit air circulation through the ventilator. Preferably, the openings 26 have a louver configuration, and include at least two louvers extending upwardly. The louvers are approximately from 0.1 to 1.0 inches wide, and from 0.5 to 5 inches long but may be of different dimensions if the application warrants. The vent includes at least one set of shielded louvers having a plurality of openings for deflecting air flow while maintaining a minimum free area for air passage such that the air flowing therethrough is substantially reduced in velocity to limit the infiltration of foreign matter.

As shown in FIGS. 1 and 2, the louvers are preferably molded into the vent walls 24 and have from 3 to about 10 louvers, preferably about 7 louvers. The louver openings are preferably about 0.15 inches high and about 3 inches long. It is preferable to have 2 shielded louvers which are essentially a mirror image of one another about the center of vents 22. Openings 26 act to change the direction of air flow through the roof ventilator so that the velocity of the air within the vent is reduced to substantially zero under normal conditions, which limits the infiltration of any foreign matter back into the residential or commercial building. It is anticipated that more than one set of louvered openings may be utilized in the vent for other various applications. The side sectional configuration of the louver basically lends itself to a parallelpiped shape. Each vent may also have support walls 28 which have top edges 30 for supporting the vent and the cap shingle secured thereto. Vents 22 are secured to lower surface 20 of flaps 14.

The ventilator 10 may be made of materials such as polymers, polypropylene, nylon, thermoplastic, epoxy resins, polyurethane or any other plastic inherent to various manufacturing methods although other metallic materials may be used. Both the cover member 12 and the vents 22 of the ventilator are preferably made from these materials, although it is possible to utilize a suitable metal such as aluminum or sheet steel. The most preferred plastic is polypropylene because it emits bug repelling odors so that insects and bugs are discouraged from nesting or entering the roof through the ventilator.

Cover member 12 is designed to provide a roof ridge ventilator with a lateral width that is substantially the same as the width of a standard cap shingle which is to be placed over the ventilator. Upon installation, the cap shingle should conform to the shape of the ventilator and thereby have the same pitch as the pitch of the roof, providing an aesthetically appealing appearance.

FIG. 2 shows a perspective view from the bottom of the vent and shows the relative placement of the inner wall 24 which has louvered openings 26 as well as the placement of the support walls 28. It is preferable that support walls 28 are located in as few places as possible, in order to increase the net free area for air flow therethrough. As illustrated in FIG. 2, each vent 22 of the ventilator includes a longitudinally extending inner wall 24 in which the vent openings 26 are provided. The louvered construction may be formed by slicing the sheet material of inner wall 24 and pressing the material into a louvered design. Alternatively, the louver openings may be formed during the injection molding process. Other fabricating techniques known to manufacturers are contemplated.

Inner wall 24 acts as an interior baffle structure to prevent foreign particles and debris from entering the roof of the building, while allowing a substantially increased net free flow area for exhausting air through the roof. Suitable connections for securing the flaps 14 to support walls 28 may include many conventional means and methods, including rivets, heat deformation, and adhesive securing methods or, if the piece is injection molded, it can be molded as a unitary piece. The shielded louver openings 26 are from about 0.1 to about 1.0 inches wide, and from about 0.5 to about 5.0 inches long. Preferably, there are at least 50 louvers extending upwardly in each roof ridge ventilator. Various designs for different embodiments are shown in FIGS. 4*a* through 4*d*.

Looking now to FIG. 3, a bottom plan view of one-half of the roof ridge ventilator is shown, showing one-half of the longitudinal groove defining hinge 16. In such a roof ridge ventilator application, a mirror image of the vent and cover member shown in FIG. 3 is attached to the other side of hinge 16. The vent 22 is shown attached to lower surface 20 of the cover member. Inner wall 24 is shown with its relative placement to support walls 28, and includes shielded louvered openings 26.

Figure 4B:
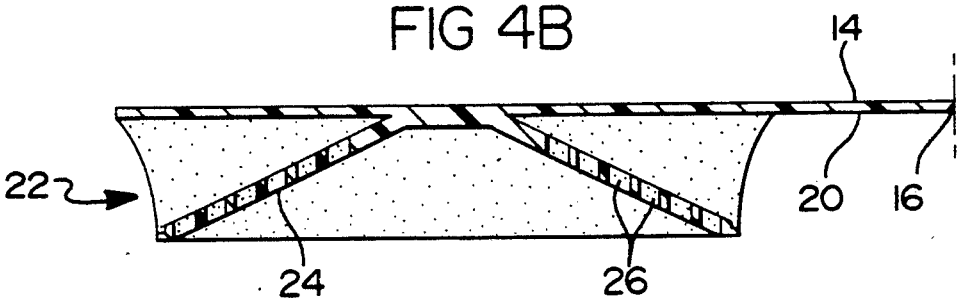
FIG. 4*b* is a side sectional view of a vent with upwardly facing shielded louver without a center support.
Figure 4C:
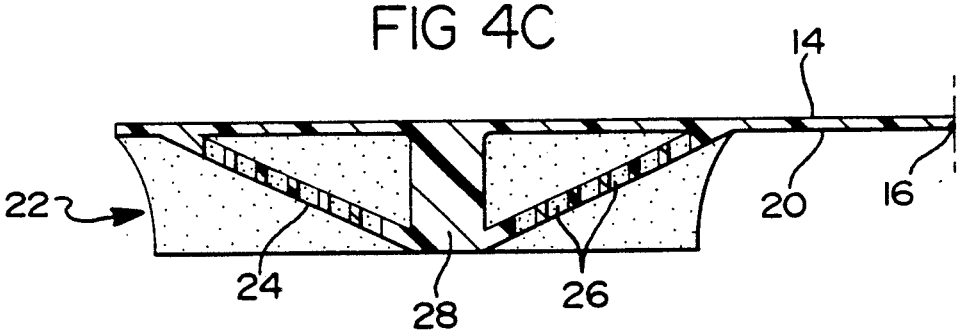
FIG. 4*c* is a side sectional view of a vent with a downwardly facing shielded louver with a center support.
Figure 4D:
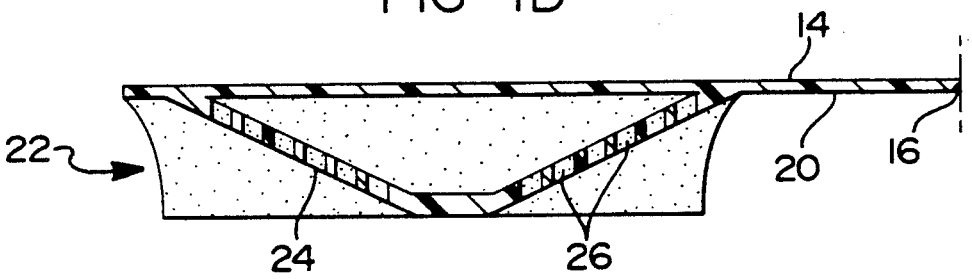
FIG. 4*d* is a side sectional view of a vent with a downwardly facing shielded louver without a center support.
Figure 5:
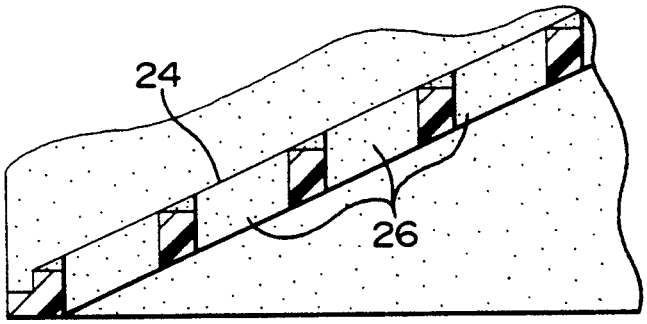
FIG. 5 is a side sectional cut-away view showing greater detail of the shielded louver feature.

Moving now to FIGS. 4*a* through 4*d*, FIG. 4*a* illustrates the vent portion taken along lines 4*a* of FIG. 3. As can be seen in FIG. 4*a*, cover member 14 has a lower surface 20 to which the vent 22 is attached. In some means of manufacture, the vent 22 is a separate piece from cover member 14, although FIG. 4*a* shows an embodiment where it has been injection molded as a unitary piece. Inner wall 24 is shown with openings 26. The shielded louvers are between openings 26 which help to deflect the air flow as it travels therethrough. As the air is deflected, the velocity of the air is reduced to substantially zero under normal circumstances before it reaches the area under the cover member 14 closest to the groove 16, which is in communication with the air inside the building as can be seen in FIG. 1. Although FIG. 4*a* shows a support wall 28 in the diagram, yet another embodiment of the invention as shown in FIG. 4*b* is the same as 4*a*, but without support wall 28. Similarly, FIG. 4*c* illustrates a vent with the inner walls 24 shown in an inverted position, and includes a support wall 28. FIG. 4*d* illustrates the inverted vent design without a support wall. FIG. 5 shows a close-up detail of the louvered openings 26 within inner wall 24.

Figure 6:
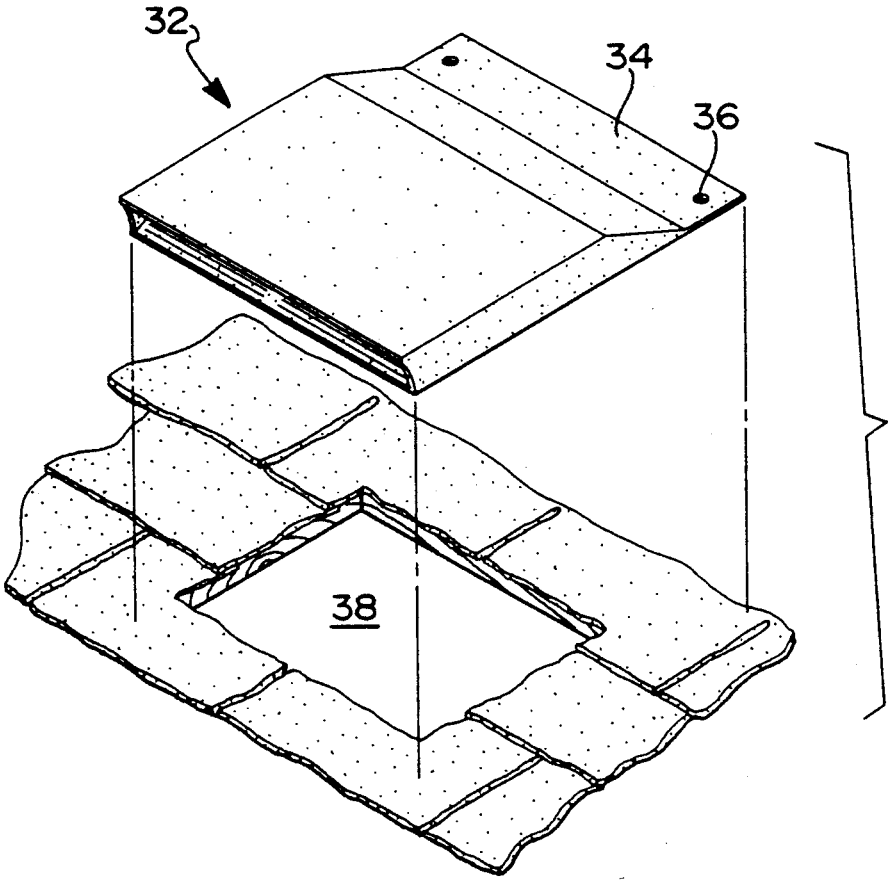
FIG. 6 is an environment view of the roof ventilator shown in the middle of the roof.

FIG. 6 shows a singular roof ventilator as it is installed in the lower portion of a conventional roof. The roof ventilator 32 has vent portions contained therein similar to those illustrated for the roof ridge ventilator 10 above, but only has one-half of the ventilator generally shown in FIGS. 1 through 4 for the roof ridge ventilator. As this is not designed to put onto a roof ridge, a longitudinally extending portion 34 is included for nailing down onto the roof by and through extending openings 36. For installation, a hole is cut into the roof as shown by numeral 38 and vent 32 is placed thereon. Longitudinally extending portion 34 is secured to the top of the roof by any fastening means through openings 36 for securement. Thereafter, a shingle (not shown) is placed over the ventilator and flashings may be used, if desired. As can be seen by the drawing, air rising through opening 38 from within the residential or commercial building is exhausted by the roof ventilator. Such a construction may provide at least one cubic foot of circulating air flow per minute per 100 cubic feet of attic space when the ventilator 32 is utilized with a conventional roof. The size of the louvered openings (not shown in this embodiment) are sufficiently small to prevent most foreign articles from passing therethrough or clogging the vents. As above, roof ventilator 32 may be made of any material, including polypropylene or other plastics which may be injection molded. The added advantage of using polypropylene is that it emits odors which repel bugs and the like. Roof ventilator 32 may be installed at any place along the roof and may of any length. Although alternative methods for securing the vent 32 may become apparent to one of ordinary skill in the art, the preferred embodiment includes longitudinally extending portion 34 for securing. Preferably, the longitudinally extending portion 34 measures approximately 3 inches in width. The ventilator may be any length but is preferably from about 6 to about 9 inches wide.

While the best mode for constructing the invention has been herein described in detail, those familiar with the art to which this invention relates will recognize various alternative ways of carrying out the invention as defined by the following claims.

What is claimed is:

1. A roof ridge ventilator to be installed under a cap shingle, comprising:

a one-piece cover member of an elongated shape including a pair of flaps, each flap having an upper surface over which cap shingles are secured and also having downwardly facing lower surfaces;

a pair of vents respectively secured to the lower surface of the cover member flaps, said vents including at least one pair of shielded louvers, the louvers having a plurality of openings for deflecting air flow and reducing air flow velocity while maintaining a minimum free area for air passage to limit the infiltration of foreign matters; and a plurality of longitudinally spaced supports in each vent that extend substantially normal to the lower surface of the cover member flaps, extending between and only up to the louvers of each pair of louvers, so as to avoid obstruction of the louvers by the supports and thereby maximize the net fee area for ventilation.

2. A ventilator as in claim 1, wherein said ventilator is made of plastic.

3. A ventilator as in claim 1, further comprising a unitary hinge located centrally between the outer edges of the cover member.

4. A ventilator as in claim 1, wherein said ventilator further includes a longitudinal groove between the flaps to permit pivotal movement of the flaps in order to allow use of the ventilator on roof ridges of different angles and pitches.

5. A ventilator as in claim 1, wherein said ventilator is formed to a length of about 5 feet.

6. A ventilator as in claim 1, wherein the width of said cover member between the outer edges is approximately the width of a standard cap shingle.

7. A ventilator as in claim 1, wherein said openings to permit air circulation include between about 3 and 10 louvers formed in the inner walls.

8. A ventilator as in claim 7, wherein said louver openings include about 7 louvers.

9. A ventilator as in claim 1, wherein said louver openings are from about 0.100 to about 1.0 inches wide.

10. A ventilator as in claim 1, wherein said louver openings are from about 3 inches long.

11. A ventilator as in claim 1, wherein said vents and cover member form a parallelepiped.

12. A ventilator as in claim 1, wherein said pair of vents are substantially mirror images of one another.

13. A ventilator as in claim 1, wherein said vents include substantially V-shaped configuration for the vent portion containing the plurality of openings.

14. A ventilator as in claim 1, wherein said ventilator is made of a plastic selected from the group consisting of polymers, polypropylene, nylon, thermoplastic, epoxy resins and polyurethane.

15. A roof ridge ventilator to be installed under a cap shingle, comprising:

a one-piece cover member of an elongated shape including a pair of flaps, each flap having an upper surface over which cap shingles are secured and also having downwardly facing lower surfaces; and a pair of vents respectively secured to the lower surface of the cover member flaps, said vents including at least one pair of shielded louvers, the louvers having a plurality of openings for deflecting air flow and reducing air flow velocity while maintaining a minimum free area for air passage to limit the infiltration of foreign matters, wherein the at least one pair of shielded louvers includes a substantially inverted V-formation for the vent portion including the plurality of openings; and a plurality of longitudinally spaced supports in each vent that extend substantially vertically, each support extending less than half-way across the vent such that the net free area is maximized.

16. A roof ridge ventilator to be installed under a shingle atop a roof surface, comprising:

a one-piece cover member of an elongated shape having an upper surface over which shingles are secured and also having downwardly facing lower surface, said cover member including a longitudinally extending portion to be secured onto the roof surface; and at least one vent respectively secured to the lower surface of the cover member, said vent including at least a pair of shielded louvers having a portion defining a plurality of openings for deflecting air flow while maintaining a minimum free area for air passage such that the louvers substantially reduce the velocity of air flowing therethrough to limit the infiltration of foreign matter;

wherein the portion defining the openings in the pair of louvers is substantially configured as an inverted V-shape of fixed dimension and angle, so as to provide structural static load bearing capability to the ventilator without reducing the net free area ventilation thereof.

17. A ventilator as in claim 16, wherein said ventilator is made of plastic.

18. A ventilator as in claim 16, wherein said ventilator is from about 6 to about 9 inches wide.

19. A ventilator as in claim 16, wherein said longitudinally extending portion of the cover member measures about 3 inches in width to be nailed to the roof surface without impeding the net free area for ventilation.

20. A ventilator as in claim 16, wherein said louver openings include about 7 louvers.

21. A ventilator as in claim 16, wherein said louver openings are from about 0.100 to about 1.0 inches wide.

22. A ventilator as in claim 16, wherein said louver openings are from about 3 inches long.

23. A ventilator as in claim 16, wherein said vents include substantially V-shaped configuration for the vent portion containing the plurality of openings.

24. A ventilator as in claim 16, wherein said ventilator is made of a plastic selected from the group consisting of polymers, polypropylene, nylon, thermoplastic, epoxy resins and polyurethane.

* * * * *